US005772007A

United States Patent [19]

Frye

[11] Patent Number: 5,772,007

[45] **Date of Patent: *Jun. 30, 1998**

[54] ELECTRIC CIRCUIT LOCK-OUT SAFETY DEVICE

[76] Inventor: James A. Frye, 2107 Avenida De Las Alturas, Santa Fe, N. Mex. 87501

[ * ] Notice: The term of this patent shall not extend beyond the expiration date of Pat. No. 5,270,503.

[21] Appl. No.: 166,187

[22] Filed: Dec. 13, 1993

Related U.S. Application Data

[63] Continuation-in-part of Ser. No. 48,422, Apr. 14, 1993, Pat. No. 5,270,503, which is a continuation of Ser. No. 966,319, Oct. 26, 1992, abandoned.

[51] Int. Cl.[6] ..... H01H 9/28

[52] U.S. Cl. ..... 200/43.14; 200/43.22

[58] Field of Search ..... 200/43.14, 43.19, 200/43.22

[56] References Cited

U.S. PATENT DOCUMENTS 2,265,438 12/1941 Marple ..... 200/43.22

FOREIGN PATENT DOCUMENTS 2659895 10/1977 Germany ..... 200/43.19

*Primary Examiner*—Renee S. Luebke

*Attorney, Agent, or Firm*—Dougherty, Hessin, Beavers & Gilbert

[57] ABSTRACT

A lock-out device for electrical circuits which includes an elongated, open sided C-shaped housing having parallel side walls each joined at an edge to a back panel. Each side wall defines a plurality of spaced, open slots. The slots in the side walls are paired in transverse alignment, and dimensioned to receive elongated locking pins. Each locking pin carries spaced annular grooves dimensioned to permit each pin to be engaged by the two side walls when the pin is placed in two aligned slots in a slot pair. A cover plate hinged to the side walls at one end of the housing pivots between an open position and a housing closed position in which it prevents removal of the locking pins from slot pairs in which they are received. The housing may be held in place to a surface adjacent the electrical circuits by a retainer clip which engages the circuit breaker panel and is crimpingly engaged with at least one of the side walls of the housing. A magnetic member may be disposed in the housing to magnetically support spare locking pins.

6 Claims, 4 Drawing Sheets

ELECTRIC CIRCUIT LOCK-OUT SAFETY DEVICE

RELATED APPLICATIONS

This application is a continuation in part of U.S. patent application Ser. No. 08/048,422, filed Apr. 14, 1993, now U.S. Pat. No. 5,270,503 which is a continuation of U.S. patent application Ser. No. 07/966,319, filed Oct. 26, 1992, now abandoned.

BACKGROUND OF THE INVENTION

1. Field of the Invention

This invention relates to a lock-out device for safely and reliably locking an electric circuit in an "OFF" or "open circuit" status.

2. Brief Description of the Prior Art

Concern for safety in the course of manufacturing and other industrial operations has heightened in recent years. Federal regulations have been promulgated and implemented which are intended to assure that there is occupational safety in the work place. Compliance with these dictates that certain specific actions shall be taken by management to assure that machines are safe to operate, and in general to be around, during the times the machines are in operation, or even when they are passive during maintenance or repair.

One such regulation requires that all electrical circuits connected to a specific machine or apparatus be turned "OFF" or interrupted, and positively locked out, at times when the machine or apparatus is being serviced or is being maintained. This assures that serious injuries or death resulting from the accidental engagement and operation of the machinery or apparatus at a time when it is thought to be inactivated will be avoided, and that precautions will be taken by management to see that safety precautions are taken in each instance to assure that the machines are positively inactivated.

In order to lock-out the power supply to machinery and apparatus at a time when the machinery is being serviced or maintained, a number of specific devices have been proposed, placed in use, and sometimes patented, for locking out switches of circuit breaker boxes at a time when these switches have been turned to the "OFF" position. This assures that there cannot be an inadvertent flipping "ON", or energization of, the circuit at these times. Formed wires or safety devices are presently offered by some electrical equipment manufacturers, and these devices can be used to lock-out/tag-out individual circuit breakers mounted inside high voltage panel boxes. Although these devices satisfy the literal requirements of the government regulations which apply, they are limited in their usefulness by certain practical considerations. For example, they are useful only in relatively large boxes containing a relatively few, widely spaced circuit breaker switches. More conventional, more widely used smaller boxes with numerous circuit breaker switches are not satisfactorily served by these devices.

Hein U.S. Pat. No. 2,978,613 describes a lock-out device for switch panels. An anchoring rod is attached to a switch panel adjacent the column of switches. Each switch has an aperture formed through the switch handle. A pair of arms is attached to the rod and one of these includes a locking pin which can be inserted into an aperture in a selected switch. The arm can then be pivoted in place to lock the switch out.

Another patent which addresses the problem of locking out a switch in a distribution panel is Leasher et. al. U.S. Pat. No. 4,006,324. This patent describes a switch lock means for switch actuators of an electrical distribution panel. The lock-out means is in the form of a bar secured to a front plate of an electrical distribution box and carrying an array of spaced bores. Locking elements are provided, and each one of them has one end which fits through a bore element in the circuit breaker, and an opposite end which fits into one end of the bore in the bar. A locking plate hinged at one end extends over and protects the bar.

U.S. Pat. No. 2,169,860 to Von Hoorn describes a guard for an electrical switch which includes a bar which extends between the side walls of guard members so as to engage and prevent movement of an operating switch lever.

A handle lock for locking a circuit breaker handle in either the "ON" or "OFF" position is disclosed in U.S. Pat. No. 2,937,248 to Michetti. The lock-out device of Michetti is a wire bent into a U-shaped configuration, with the free ends of the wire being bent inwardly toward each other. The circuit breaker handle is provided with a through hole or with recesses for reception of these opposite free ends of the U-shaped wire. When the wire is positioned with its free ends in the recess or through hole in the circuit breaker handle, the wire can be abutted against a backing element to prevent the handle from being pivoted from one position to the other.

Other devices for locking a circuit breaker switch in the "ON" position or the "OFF" position are shown in Pastene U.S. Pat. No. 3,109,899; Palmer U.S. Pat. No. 3,408,466; Dietz U.S. Pat. No. 3,629,529; Dimarco et. al. U.S. Pat. No. 4,300,030; Kobayashi et. al. U.S. Pat. No. 4,733,029 and Johnson et. al. U.S. Pat. No. 3,784,766.

Many of the foregoing devices are quite expensive in construction and some of them are bulky and heavy and difficult to place in operation. A need exists for an easily mounted, easily used and reliable switch lock-out or lock-on device which can be afforded and which assures a high degree of safety during its use.

BRIEF DESCRIPTION OF THE PRESENT INVENTION

The present invention provides a lock-out device for positively and reliably locking out an electrical circuit by mechanically preventing the movement of a toggle switch handle from the "OFF" position to the opposite position, once the lock-out device is placed in use. The lock-out device of the present invention is developed for the purpose of providing a relatively inexpensive, yet positive, lock-out device where any one or all of a number of switches located in a switch bank within a circuit breaker box can be locked out individually or simultaneously, and a single padlock then used to prevent access to any of the mechanism of the lock-out device. Moreover, the lock-out device is sufficiently simple and well thought out that it can be used successfully with most circuit breaker boxes and switch panels currently in use.

Broadly described, the lock-out device of the invention includes an elongated open-sided housing which is C-shaped in cross-sectional configuration. The housing has a pair of elongated parallel side walls. Each of these side walls is adjoined along its longitudinal edge to the back panel and each side wall extends perpendicular to the back panel. In one embodiment, the back panel defines a plurality of fastener apertures by which the lock-out device may be secured to the panel of a switch box by means of screws, bolts or other fasteners. In an alternate embodiment, a retainer clip fits over the side walls and extends through an opening in the panel of the switch box to secure the housing without other fasteners.

Each side wall of the elongated housing defines a plurality of spaced, opened slots. These are aligned so that alternate slots in the two side walls form an aligned pair. The slots are dimensioned to receive elongated locking pins. Each locking pin carries a pair of longitudinally spaced annular grooves which extend around the locking pin. These grooves are dimensioned to permit each pin to be engaged by the two side walls of the housing when the pin is placed in the two aligned slots in one of the slot pairs. A cover plate is hinged to the side walls at one end of the housing, and is pivoted between an opened position and a housing-closed position. In the latter position, this cover prevents the locking pins from being removed from the slot pairs in which they are located. Means is provided for locking the cover to the housing so that access to the locking pins is prevented at all times during the operation of the system. Each locking pin functions by having one end which is positioned to bear against, and prevent movement of, a toggle switch operating cover or arm when the switch has been switched to the "OFF" position. At its opposite end, each locking pin carries an aperture which facilitates the attachment of a tag for visually indicating that that particular circuit is locked out by the use of the locking pin forming a part of the lock-out device of the invention and carrying the tag.

An important object of the invention is to provide a circuit breaker toggle switch lock-out device which can be used by a person with little or no training in the use of the device, and upon the communication to such person of simple, minimal instructions.

A further object of the invention is to provide a lock-out device for locking a toggle switch in an "OFF" position by a positive mechanical lock. This assures that the switch cannot be thrown to any position other than that which it is in at the time when the lock-out device is placed in use.

A further object of the invention is to provide a lock-out device which is ruggedly constructed, and is characterized as having a long and trouble free operating life.

Another object of the invention is to provide a switch lock-out device in which all of the relatively few components needed to make up the device are fabricated of high strength material, and the number of moving parts in the device need never exceed three.

A further object of the invention is to provide a lock-out device which can be easily set up and placed in operation by an operator with no special training in doing so, but which, when set into its operative position, cannot be inadvertently or deliberately altered so that electrical circuits locked out by means of the device are returned to an "ON" status.

A further object of the invention is to provide a lock-out device which, when installed in a breaker box having two banks of toggle switches located on opposite sides of a center line, can be used for operating any toggle switch in either one of the banks.

Additional objects and advantage will become apparent as the following detailed description of the invention is read in conjunction with the accompanying drawings which illustrate certain preferred embodiments of the invention.

GENERAL DESCRIPTION OF THE DRAWINGS

FIG. 2 also shows the cover of the lock-out device closed and locked to prevent tampering with, or removal of, the locking pins.

FIG. 6 is an elevation view of a part of a side plate used in the housing employed in a modified embodiment of the invention.

DETAILED DESCRIPTION OF PREFERRED EMBODIMENTS OF THE INVENTION

Figure 1:
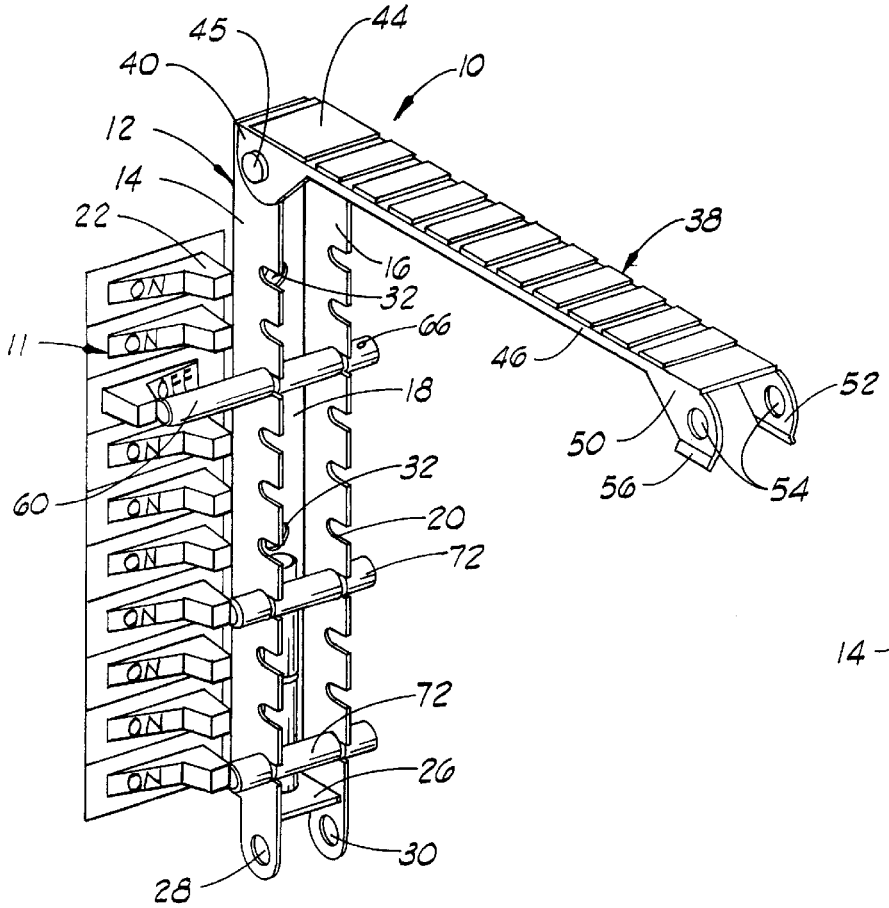
FIG. 1 is a perspective view of the lock-out safety device of the invention. It is shown mounted in an operative position adjacent a bank of switches used in a typical circuit breaker box.

One preferred embodiment of the lock-out device 10 of the present invention is illustrated in a perspective view in FIG. 1, along with an adjacent bank 11 of toggle switches used in a circuit breaker box assembly. Both are mounted vertically on a wall at the location of a switch box or circuit breaker box as hereinafter described. The lock-out device 10 includes an elongated housing 12 which is open at one of its sides, and includes a pair of spaced, opposed, substantially parallel elongated side walls or plates 14 and 16. These side walls 14 and 16 extend from one end of the housing to the other, and each is secured along one longitudinal side edge to a back plate or panel 18. Each of the side walls 14 and 16 extends normal to the plane of the back panel 18.

At the respective free longitudinal edges of the side walls 14 and 16 opposite the edges secured to the back panel 18, each side wall carries a plurality of longitudinally spaced slots or recesses 20. The slots or recesses 20 are identical to each other in configuration. Each slot is of a generally U-shaped configuration, having a rounded or generally semicircular bottom 20*a*, and a pair of parallel side edges 20*b* and 20*c* (see FIGS. 3 and 5).

It will be perceived in referring to FIG. 1 that the number of the slots 20 cut in the side walls 14 and 16 of the housing 12 is at least equal to the number of switches 22 in one toggle switch bank 11 in the circuit breaker box, and that the spacing of the slots corresponds to the spacing of the switches. It will also be perceived in referring to FIG. 1 that each of the side walls 14 and 16 of the housing 12 projects downwardly to a location substantially below the lowermost of the slots 20, and beyond a transverse bottom plate 26 which extends between the two side walls at that location. At their lower ends, the two side walls 14 and 16 are preferably rounded and carry a pair of aligned apertures 28 and 30.

The positional relationship of the shaped slots 20 in the two side walls 14 and 16, as these slots are perceived in the perspective view of FIG. 1, is that slots in opposed side walls are transversely aligned so that they are paired. This permits a pair of slots to receive a transversely extending locking pin as hereinafter described. Thus, for each of the toggle switches 22 in the circuit breaker box, there is a pair of aligned slots 20 formed in the side walls 14 and 16 of the housing 12.

A fastening means is used to mount the lock-out device 10 of the invention in the positional relationship to the circuit breaker box which contains the bank 11 of toggle switches 22. In one embodiment, a plurality of fastener holes 32 are formed through the back panel 18 and through shim plates or washers 34 (see FIGS. 4 and 5) so that the housing 12 can be bolted or screwed with suitable fasteners 35 to the inner face plate 36 of the circuit breaker box or a switch box. The lock-out device 10, can also, of course, be mounted against a wall. An alternate embodiment, which uses a retainer clip rather than fasteners 35 will be further described herein.

In order to close the housing during operation of the lock-out device in a manner hereinafter described, an elongated cover subassembly 38 is provided. The cover subassembly 38 is C-shaped in cross-sectional configuration, and carries a pair of protuberant connecting ears 40 and 42 at one end of the cover subassembly. The cover subassembly 38 further includes a web plate 44 (see FIG. 4) and a pair of lateral parallel side flanges 46 and 48. The protuberant ears 40 and 42 function to receive a pivot pin 45 extended therethrough, and through registering apertures (not visible) in the side walls 14 and 16 of the housing 12. The protuberant ears 40 and 42 are formed integrally with the lateral flanges 46 and 48 of the cover subassembly 38. It will be noted as reference is made to FIGS. 3 and 4 that the lateral flanges 46 and 48 are spaced to fit snugly on the outer side of, and frictionally engage, the outer surfaces of the housing side walls 14 and 16.

At the opposite ends of the lateral flanges 46 and 48 from the ends thereof at which the protuberant connecting ears 40 and 42 are located, a second pair of protuberant latching ears 50 and 52 are formed at the ends of the lateral flanges 46 and 48, respectively, and project away from the web plate 44. Each of the protuberant locking ears 50 and 52 carries a locking aperture 54, and outwardly from this, a small, outwardly flared guide flange 56. The locking apertures 54 in the protuberant ears 50 and 52 are aligned with each other, and are also positioned on the cover subassembly 38 so that when it is pivoted to its closed position, as shown in FIGS. 3 and 4 of the drawings, the protuberant locking ears 50 and 52 are moved to a closed position closely outside of, and adjacent the ends of, the side walls 14 and 16 of the housing 12.

Figure 13:
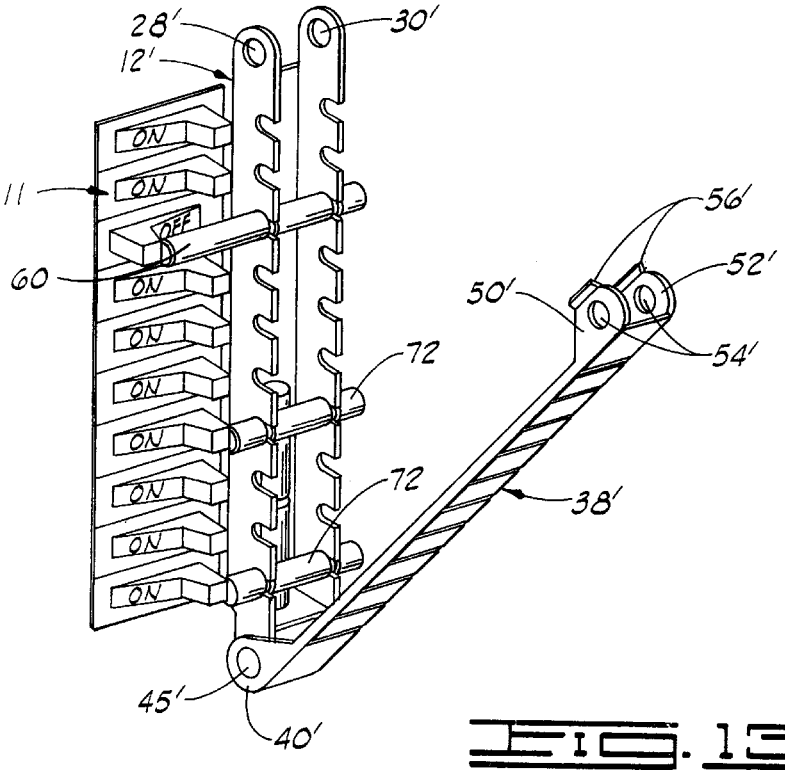
FIG. 13 is a perspective view of an alternate embodiment of the invention showing the cover of the lock-out device pivoted at its lower end.

In the closed position, the locking apertures 54 formed in the protuberant locking ears 50 and 52 are precisely aligned with the locking apertures 28 and 30 formed in the ends of the side walls 14 and 16 of the housing 12. The cover sub assembly 38 illustrated in FIG. 1 is hinged at the top. However, it will be understood by those skilled in the art that the cover assembly could be hinged at the bottom. Referring to FIG. 13, a cover subassembly 38' is illustrated hinged at the bottom of a housing 12' by means of a pivot pin 45' which extends through ear 40' on the lower end of the cover subassembly. Protuberant locking ears 50' and 52' may be moved to a closed position such that locking apertures 54' therein are precisely aligned with locking apertures 28' and 30' in housing 12'.

Figure 3:
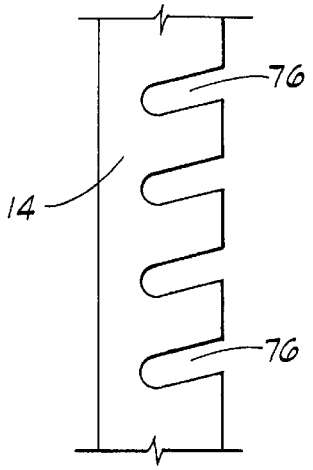
FIG. 3 is a sectional view taken along line 3—3 of FIG. 2.
Figure 4:
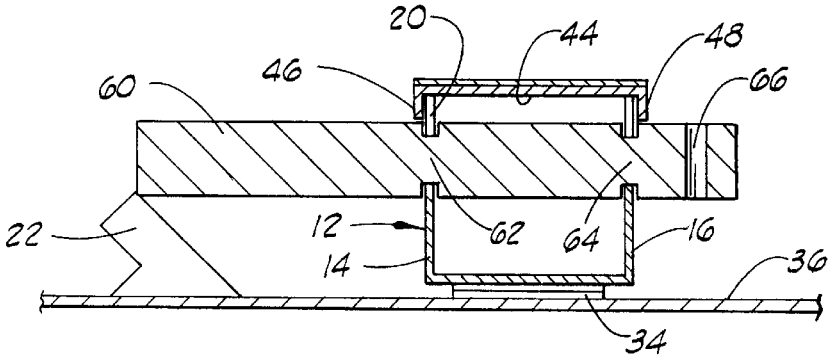
FIG. 4 is a sectional view taken along line 4—4 of FIG. 2.
Figure 2:
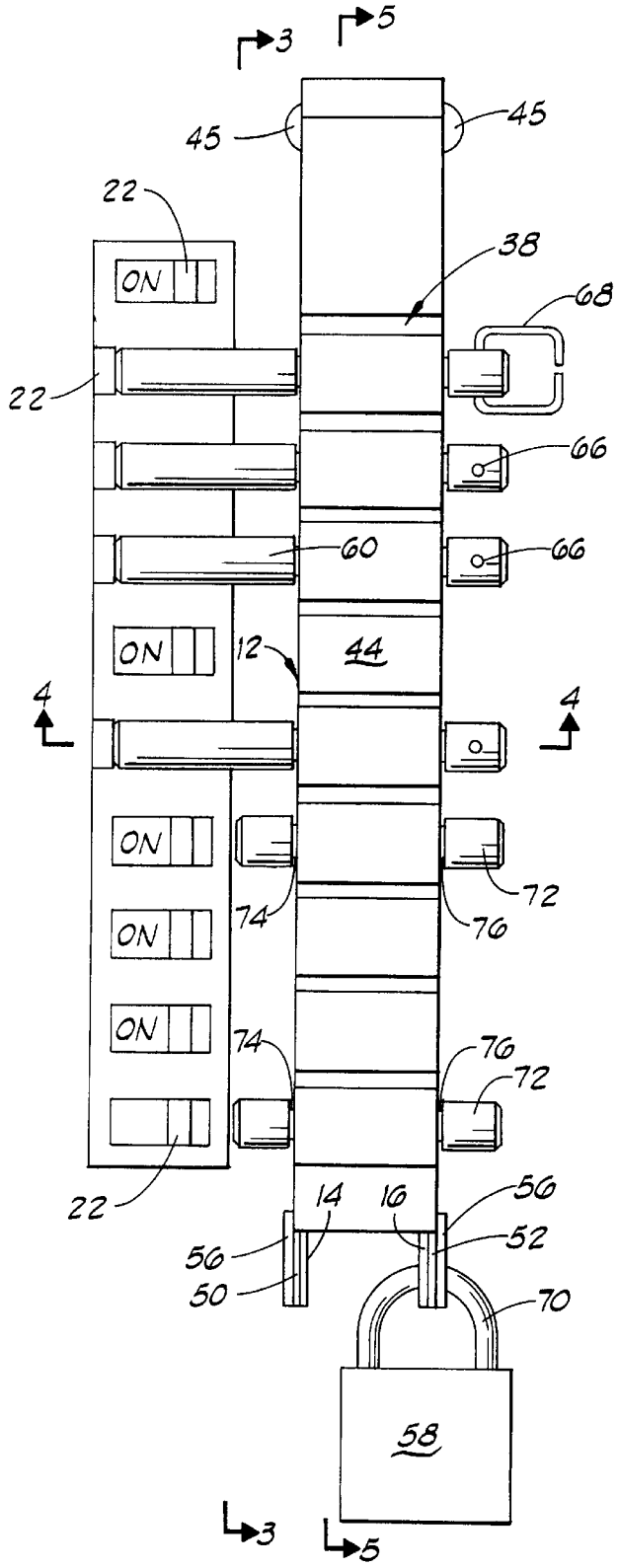
FIG. 2 is a front elevation view of the lock-out safety device of the invention, showing it in use for locking out certain circuit components by locking toggle switch elements in the "OFF" position.
Figure 3:
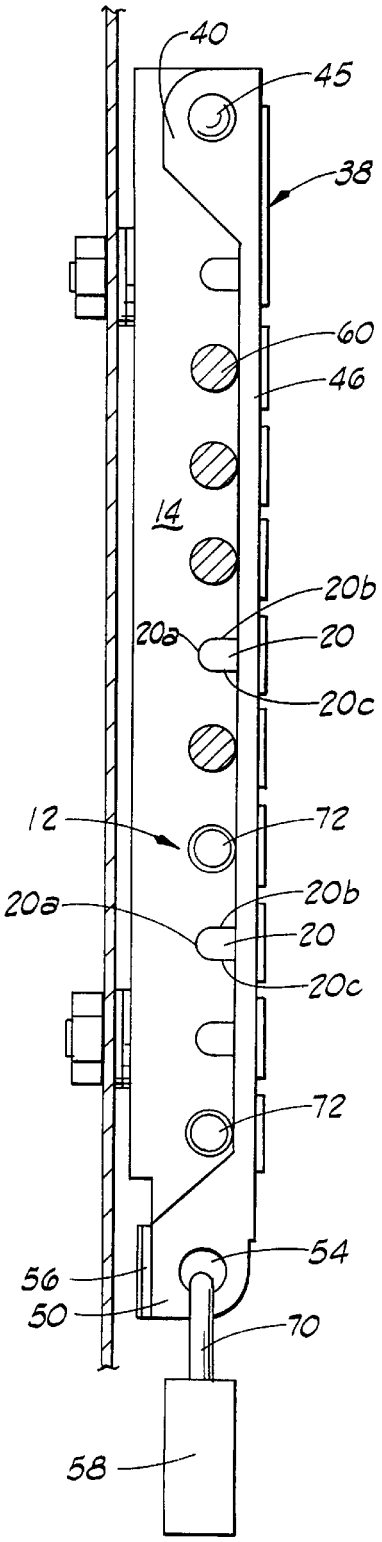

In the closed position of either embodiment of the lock-out device 10, a lock 58, such as is shown in FIGS. 2 and 3, can be employed to lock the cover subassembly 38 or 38' in its closing position in which it fits closely on top of the housing 12 or 12'. It functions at this time to retain certain locking pins 60 in a selected position within the housing 12 or 12', and in relation to the toggle switches 22.

Referring again to FIGS. 1–5, a plurality of the locking pins 60 are provided for the purpose of locking out selected electrical circuits by retaining a selected toggle switch 22 in a breaker box in an "OFF" position. Each of the locking pins 60 preferably has an outside diameter of about three-eighths inch and is about three inches long in a typical lock-out device constructed in accordance with a preferred embodiment of the present invention. Pins of other dimensions can also be used, however. Each of the locking pins 60 can be used to mechanically and positively lock out any one circuit controlled by a toggle switch located on either of the two opposite sides of the breaker box. This can be accomplished by simply reversing the orientation of the locking pins 60 in the housing 12. In the drawings, however, only the toggle switches located in a bank of switches located to the left of the lock-out device 10 has been shown for simplicity of illustration. A pair of pins 60 are typically provided, but additional pins can be easily provided, and some of these can be stored within the housing 12 as hereinafter explained.

Figure 7:
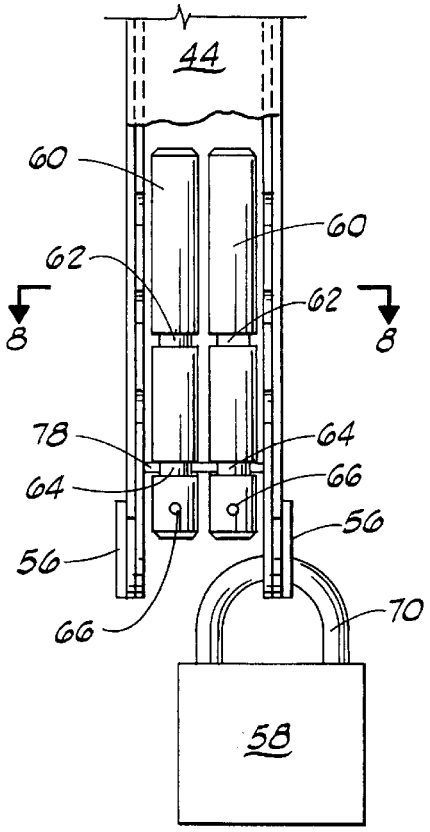
FIG. 7 is a view partly in elevation and partly in section, where a part of the pivoted cover has been broken away, and illustrating the manner in which spare locking pins which are not in use are stored in the bottom of the housing in a modified embodiment of the invention.

The locking pins 60 are manufactured to have two annular grooves 62 and 64 machined around each pin at axially spaced positions therealong (see FIGS. 4 and 7). The grooves 62 and 64 are thus located to engage a pair of the slots 20 formed in the side walls 14 and 16 of the housing 12 and aligned as previously explained. These grooves 62 and 64 are of a transverse width such that they can accept the metal plates forming the side walls 14 and 16 of the housing 12 when they are pushed into the slots 20 as illustrated in FIG. 4 of the drawings.

One end portion of each pin 60 is approximately one-half inch long as measured from one of the annular grooves 64 outwardly to the pin end. The opposite end of each pin 60 is located about one and one-half inches from the other groove 62 of the two grooves. The long end of each pin is anodized "safety red" to facilitate its immediate identification. The short end of each of the locking pins 60 is provided with a cross drilled hole 66 for conveniently attaching a lock-out tag (not shown) by means of a suitable ring means 68 as illustrated in FIG. 2. When one of the locking pins 60 is in place to retain one of the toggle switches 22 in a locked out position, anyone opening the breaker box will immediately observe the red section of the pin pressing against the switch arm, and they will observe the safety tag wired to the opposite end of the pin.

It will be noted in referring to FIGS. 2 and 3 that when the cover subassembly 38 is swung in and down to a housing-closing position, and a lock hasp 70 is inserted through the aligned hasp holes or apertures 28 or 30 and 54, the cover subassembly 38 is locked so that any locking pins 60 which have been placed in aligned slot pairs are trapped by the shortened flanges 46 and 48 of the cover subassembly, and thus they cannot be removed until the cover is opened to permit access to the pins.

Figure 5:
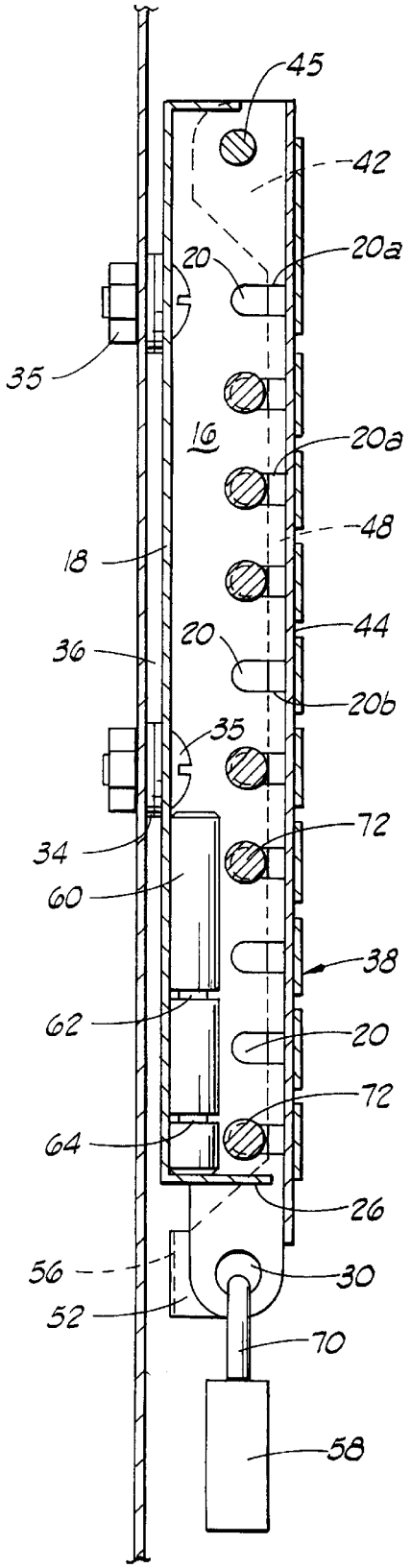
FIG. 5 is a sectional view taken along line 5—5 of FIG. 2.

In one embodiment of the invention, spare locking pins 60 which are not in use for locking out one of the toggle switches 22 are retained or stored inside the lower portion of the housing 12 by placing them so that one lower end of the stored locking pins rest against the bottom plate 26. The pins 60 flatly abut or contact the back panel 18 of the housing 12, and they are held in this position, as illustrated in FIGS. 1 and 5, by means of relatively short retainer pins 72. Two of the retainer pins 72 are illustrated in FIGS. 1, 2 and 5. It will be noted that the relatively short retainer pins 72 are cylindrical pins with a pair of axially spaced grooves 74 and 76 therein similar, in the sense of the dimensions and spacing of these grooves, to the grooves 62 and 64 formed in the locking pins 60. Thus, the retainer pins 72 may be fitted into appropriate slots 20 in the side walls 14 and 16 so as to retain the spare or reserve locking pins 60 stored in the bottom of the housing 12 until they are needed for use to lock-out certain circuits by locking one or more toggle switches 22 in the "OFF" position as shown in FIG. 1.

Figure 8:
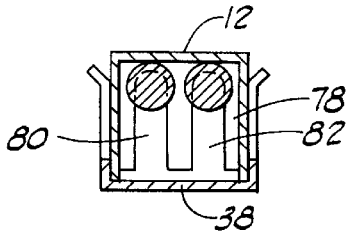
FIG. 8 is a sectional view taken along line 8—8 of FIG. 7.

As an alternative to the described embodiment in which the extra non-used locking pins 60 are rested upon the rectangular bottom panel or plate 26, the bottom panel can instead be of the type depicted in FIGS. 7 and 8. Here, the bottom panel or plate is denominated by reference numeral 78, and is provided with a pair of deep slots 80 and 82. These slots 80 and 82 are typically one-quarter inch wide, and are thus dimensioned to snugly engage the annular grooves 64 cut around the locking pins as previously described. This provides support for, and retention of, the spare locking pins.

This method of storing the extra or spare locking pins 60 is preferred to the use of the embodiment depicted in FIGS. 1 and 5. It is preferred because it is generally capable of storing or retaining four locking pins 60 instead of two, and further, it permits the one-half inch long sections of the retainer pins which project below the slotted end plate or panel 78 to be viewed from the outside of the closed housing. This provides the technician with a visual indication as to the available number of spare locking pins 60 without his/her having to first unlock the cover subassembly 38 of the lock-out device. In installations which require that the lock hasp-receiving section of the lock-out device 10 be shortened because of space limitations, however, the arrangement shown in FIGS. 6 and 7, where the one-half inch pin ends of the spare retainer pins 60 are exposed, would be undesirable because the protruding pins might then interfere with the location in the locking position of the padlock hasp 70.

Figure 9:
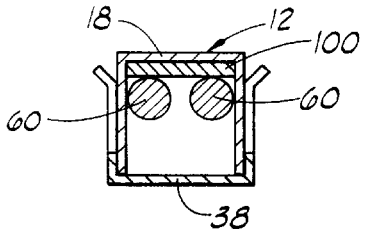
FIG. 9 is a sectional view similar to that in FIG. 8 and showing an alternate means of storing spare locking pins.
Figure 10:
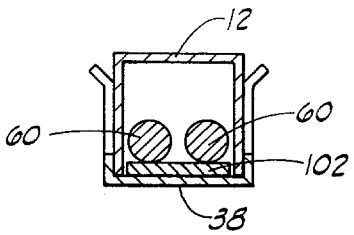
FIG. 10 is a sectional view similar to FIGS. 8 and 9 and showing another alternate embodiment of the manner in which the spare locking pins are stored.

Referring now to FIG. 9, another alternative for storage of spare or reserved locking pins 60 is disclosed. In this embodiment, a magnetic member 100 is magnetically or otherwise affixed to the inside of back panel 18 of housing 12. The stored locking pins 60 are then magnetically retained within housing 12. Still another alternative as shown in FIG. 10 is magnetically or otherwise affixed to the inside of cover subassembly 38 and is thus used to magnetically retain non-used locking pins 60.

Where two retainer pins 72 are used to hold the spare or extra locking pins 60 within the housing 12, as shown in FIGS. 1 and 5, they can be quickly and easily removed to permit the extra locking pins to be accessed. At this time, the retainer pins 72 can be temporarily stored by pressing each of them into any two convenient, unused paired slots located in the upper end portion of the housing. When the locking pins 60 are returned to a stored status after equipment service is completed, and the housing is re-opened by pivoting the cover subassembly 38 upwardly, the two retainer pins 72 can then be pressed back into their original slots in the lower portion of the housing to form a storage magazine for the extra or non-used locking pins.

In an alternate embodiment of the invention illustrated in FIG. 6, the side walls or panels 14 and 16 define differently shaped grooves 76, each of which is angled so as to slope downwardly from the open mouth of the slot toward the lower end of the housing 12. This arrangement affords greater assurance of retention of the pins which are provided, but is slightly more expensive to fabricate.

Figure 11:
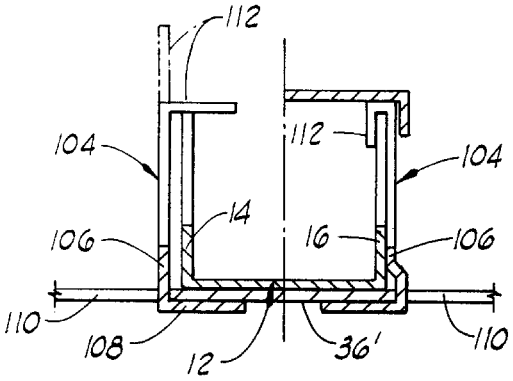
FIG. 11 is a cross section similar to FIG. 4 and showing an alternate means of mounting the lock-out device of the invention to a typical circuit breaker box.
Figure 12:
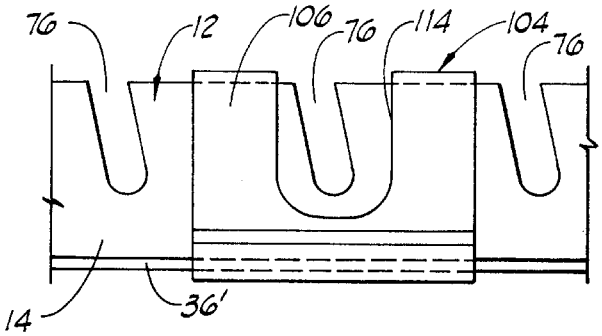
FIG. 12 is a side elevational view of the alternate embodiment of FIG. 11.

Referring now to FIGS. 11 and 12, an alternative means is shown for mounting housing 12 to face plate 36' of the circuit breaker box. In this embodiment, housing 12 is retained against face plate 36' by a retainer clip 104. In its original configuration, retainer clip 104 has a substantially L-shaped cross-sectional configuration formed by a side panel 106 and a flange 108 extending perpendicularly therefrom.

Face plate 36' is configured such that it defines a pair of openings 110 on opposite sides of housing 12. Flange 108 of retainer clip 104 is inserted through an opening 110 such that side panel 106 is adjacent to a side wall 14 or 16 of housing 12, as illustrated on the left side of FIG. 11. The outermost portion 112 of retainer clip 104 extends outwardly from face plate 36' and is substantially perpendicular thereto as shown by phantom lines in FIG. 11. This outermost portion 112 of the side panel 106 is then bent toward housing 12 such that retainer clip 104 takes on a substantially C-shaped configuration as shown by the solid lines on the left-hand side of FIG. 11. The installation of retainer clip 104 is completed by crimping it such that it is wrapped around side wall 14 or 16 of housing 12 as seen in the right-hand side of FIG. 11. In this configuration, the major portion of side panel 106 is immediately adjacent the corresponding side panel 14 or 16 of housing 12, and outermost portion 112 is wrapped around the outer end of side panel 14 or 16 such that housing 12 is clamped in place against face plate 36'. Preferably, a retainer clip 104 is used on both sides of housing 12 to clampingly engage both side panels 14 and 16 of the housing as seen in the right side of FIG. 11.

Referring now to FIG. 12, side panel 106 of retainer clip 104 defines a substantially U-shaped aperture therein which is adapted for general alignment with the corresponding grooves 76 (or 20) defined in the corresponding side panels 14 and 16 of housing 12. In this way, the grooves are not covered and placement of locking pins 60 is not hindered by retainer clip 104.

DISCUSSION AND OPERATION

The lock-out device 10 of the invention is constructed so that it is accommodated to use with all types of circuit breaker box construction which are commonly employed in the United States and most foreign countries. It is a common and conventional design characteristic of circuit breaker boxes that they are arranged in two banks with a vertical bank of toggle-type breaker switches to the left, and another bank of toggle switches to the right of one facing a wall upon which they are mounted. Each circuit is disengaged or opened by moving a breaker switch to the "OFF" position, and in the case of any one of the toggle switches, this movement is away from the vertical center line of the two-bank circuit breaker box. Thus, those switches on the left are moved toward the left to turn them "OFF", and these circuits and switches are normally oddly numbered. Those in the bank to the right of the center line (in the sense of the operator facing the breaker box) are for even numbered circuits and their switches are moved toward the right to move the switch to the "OFF" position.

The lock-out device 10 of the present invention can typically be used between the two vertical banks of toggle switches in a circuit breaker box of conventional construction, and the construction of the locking pins 60 permits them to be used either to lock-out circuits to the left after moving the toggle switches in that bank toward the left to the "OFF" position, or to be used to lock-out the even numbered circuits to the right by reversing the position of the pins so that the long end (which is anodized red for safety) extends toward the right and locks a selected toggle switch in the "OFF" position. For discussion purposes in the present application, only the left hand bank 11 of toggle switches 22 in a circuit breaker box has been illustrated in FIGS. 1, 2 and 13 of the drawings.

In typical breaker box construction, the vertical spacing for the circuit breaker toggle switches 22 in the vertical bank 11 of switches is uniform. Therefore the housing wall slots 20 in the lock-out device of the present invention are also uniformly vertically spaced from each other on precisely the same intervals as the spacing intervals upon which the toggle switches in the breaker box are positioned. Thus, each locking pin 60 will be aligned with a corresponding circuit breaker switch 22 when the pin is placed in the proper position.

The lock-out device 10 of the present invention provides positive, individual circuit lock-out capability for the majority of electrical circuit breaker boxes currently in service, as well as many which can be currently envisioned. Such boxes may house from twenty to fifty-four closely spaced circuit breaker switches, and yet be accommodated quite easily and effectively by the lock-out functions of the present invention.

The lock-out device 10 is very simple to use and does not require special training or exceptional physical ability. The operation of the lock-out device involves relatively few steps. First, the breaker box door is open and the appropriate circuit is switched "OFF" by flipping the appropriate toggle switch to the "OFF" position. A check of the circuitry is made then to be sure that the circuit is de-energized by this manipulation of the toggle switch.

Next, the cover subassembly 38 or 38' of the lock-out device 10 is opened by removing the padlock 58 and swinging the cover subassembly out and through an angle of about 90°. At this time, from one to eight locking pins 60 are selected and placed in a corresponding number of slot pairs made up of aligned slots 20 (or 76) in the two side walls of the housing 12 or 12'. The aligned slot pairs correspond to, and are aligned with, the toggle switches 22 which have been thrown to the lock-out position. It may be necessary to use all of the stored or stand-by pins in the bottom of the housing 12 or 12', as well as some additional pins located and stored in a convenient maintenance center.

To achieve the locked out status, the locking pins 60 are simply slipped into the housing slots 20 which correspond to, and are aligned with, each switched "OFF" toggle switch 22. Once the pins 60 are in position, a check is made to be sure that each is firmly engaged with the respective switch and that the switch is closed against the red color coded end of the locking pin. The short end of the pin 60 will always be on the opposite side of the lock-out device housing 12 or 12' from that side at which the red, relatively long end of the pin, and the locked out toggle switch, are located. Each of the respective switches 22 is then "locked out" and cannot move back to the right against its respective locking pin 60. The last step is simply that of closing and locking the cover subassembly 38 or 38' of the housing 12 or 12' to assure that the locking pin 60 remains in its locking position.

It should be noted when one of the pins 60 is in a locking status and is engaged in a pair of aligned slots 20 within the housing 12 or 12', it is then oriented in space and in its relationship to the housing and to the toggle switch 22 locked out by the pin so that it then has three theoretical directions of possible movement. These are "up" and "down" along the vertical axis of the housing (movement in the "Y" plane), movement along the axis of the pin or side ways (movement in the "X" plane), and movement out of the slot, or, stated differently, in a direction perpendicular to and away from the back panel of the housing (movement in the "Z" plane). When the cover subassembly 38 or 38' is closed over the housing 12 or 12' and is locked by the padlock 58, the flanges 46 and 48 at opposite sides of the cover subassembly bear against the locking pins (as shown in FIG. 4), and prevent them from falling out of the slots 20 in the housing by movement in the "Z" direction. At the same time, the annular grooves 62 and 64 in each one of the locking pins 60 are engaged by the side walls 14 and 16 of the housing 12 or 12', and this prevents movement of the locking pins in either the "X" or the "Y" plane. Thus, when the locking pin is in the proper position to lock-out the switch, and the cover of the housing is closed, the switch will fracture before it can return to the "ON" position. The only moving part of the lock-out device, if the locking pins are not considered to be moving parts, is the cover subassembly 38 or 38' which operates to close the housing 12 or 12' and secure the locking pins 60 in position.

In sum, when the cover subassembly 38 or 38' is closed and locked to the housing 12 or 12' by means of the padlock 58, none of the locking pins 60 which are then used for locking out the circuits by having one end thereof in contact with the toggle switches in the "OFF" position can be inadvertently or deliberately removed. As explained above, movement of the pins 60 in any direction is prevented by structure, yet access can be had at any time to one or more of the pins 60 by the opening of the single padlock 58 used to hold the cover subassembly 38 or 38' in a locked status in relation to the housing 12 or 12'. A single lock thus controls access to all the energized circuits.

Although a preferred embodiment of the invention has been herein described in order to afford guidance to those having ordinary skill in the art, so that the principles of the invention can be fully utilized, even in different (and perhaps better) structural forms, such changes as these innovations of form are nevertheless intended to be encompassed by the spirit and scope of the present invention, unless the same falls clearly outside of the appended claims when they are given a reasonable interpretation to expand their scope to the maximum extent permitted by law.

What is claimed is:

1. A lock-out safety device for electrical circuits comprising:

a housing, including a pair of opposed, elongated side walls each defining a plurality of longitudinally spaced, open slots, with the slots in said side walls being aligned in longitudinally spaced pairs, with each pair including one slot in one of said side walls, and another transversely aligned slot in the other of the side walls;

at least one elongated locking pin substantially longer in its length than the distance between said side walls and including and defining a pair of longitudinally spaced grooves therein positioned along the length of the locking pin and dimensioned so that the locking pin is engaged by two of said slots in a selected slot pair, with said slots in said selected pair of slots interlockingly mating with said grooves in said locking pin to immobilize said locking pin against movement in the direction of its longitudinal axis, and in a direction which is longitudinal and parallel with respect to said side walls, each of said locking pins having an axially extending portion projecting outwardly from said housing in a direction substantially normal to the plane of the nearest one of said side walls and adapted to limit movement of a toggle switch handle between "OFF" and "ON" positions;

a cover subassembly connected to said housing and covering said side walls, slots and locking pins so as to prevent extrication of said locking pins from said slot pairs in which they are located; and a magnetic member disposed in said housing for magnetically supporting spare locking pins.

2. The lock-out device of claim 1 wherein:

said housing further includes a back panel extending substantially normal to said elongated side walls and secured to longitudinal side edges of said side walls; and said magnetic member is affixed to said back panel.

3. The lock-out safety device of claim 1 wherein said magnetic member is affixed to said cover subassembly.

4. The lock-out safety device of claim 1 further comprising a retainer clip for clampingly holding said housing to a vertical surface adjacent a circuit breaker switch bank.

5. A lock-out safety device for use adjacent a circuit breaker switch bank comprising:

a housing, including a pair of opposed, side walls; and retainer means for clampingly engaging at least one of said side walls and a surface adjacent the circuit breaker switch bank and thereby securing said housing to said surface, said retainer means being characterized by a retainer clip comprising:

a flange positionable adjacent said surface by insertion through an aperture defined in said surface; and a side panel extending substantially perpendicularly from said flange, said side panel having an outer portion adapted for crimping around an outer end of said side panel such that movement of said housing away from said surface is prevented.

6. The lock-out safety device of claim 5 wherein each of said side walls defines a slot therein transversely aligned with the slot in the other of said side walls; and said side panel of said retainer clip defines an aperture therein adapted for alignment with one of said slots such that access to the one slot is not inhibited.

* * * * *